US005343931A

United States Patent [19]

Striuli et al.

[11] Patent Number: 5,343,931

[45] Date of Patent: Sep. 6, 1994

[54] CRYSTALLIZER, OR INNER PORTION, OF A MOLD FOR THE CONTINUOUS CURVED CASTING OF THIN SLABS

[75] Inventors: Mirco Striuli, S. Dona' Di Piave; Fabio Borlina, Torre Di Mosto; Wogler Ruzza, Udine, all of Italy

[73] Assignee: Danieli & C. Officine Meccaniche SpA, Buttrio, Italy

[21] Appl. No.: 969,339

[22] Filed: Oct. 30, 1992

[30] Foreign Application Priority Data

Oct. 31, 1991 [IT] Italy ..... UD91 A 000182

[51] Int. Cl.[5] ..... B22D 11/04

[52] U.S. Cl. ..... 164/418; 164/459

[58] Field of Search ..... 164/418, 459, 436, 437, 164/439

[56] References Cited

U.S. PATENT DOCUMENTS

| | | | |
|---|---|---|---|
| 4,635,702 | 1/1987 | Kolakowski | 164/418 |
| 4,716,955 | 1/1988 | Fastert | 164/418 |
| 4,926,930 | 5/1990 | Gay | 164/418 |
| 4,928,747 | 5/1990 | Pleschiutschnigg | 164/418 |
| 5,188,167 | 2/1993 | Perry | 164/418 |

FOREIGN PATENT DOCUMENTS

| | | | |
|---|---|---|---|
| 0149734 | 10/1984 | European Pat. Off. . | |
| 0230886 | 1/1987 | European Pat. Off. . | |
| 0276418 | 12/1987 | European Pat. Off. . | |
| 0300953 | 6/1988 | European Pat. Off. . | |
| 898667 | 12/1953 | Fed. Rep. of Germany | 164/459 |
| 3501422 | 1/1985 | Fed. Rep. of Germany . | |
| 3907351 | 3/1989 | Fed. Rep. of Germany . | |
| 175146 | 3/1989 | Japan | 164/418 |

*Primary Examiner*—P. Austin Bradley
*Assistant Examiner*—Rex E. Pelto
*Attorney, Agent, or Firm*—Antonelli, Terry, Stout & Kraus

[57] ABSTRACT

Crystallizer, or inner portion, of a mold for the continuous curved casting of thin slabs, which has at least its outer curved extrados plate (10) containing a substantially central enlargement hollow (11) starting from the upper surface (13) of the outer plate (10) and being reduced progressively, to zero in the curved inner surface (12) of the plate (10) for sliding of the molten metal, the enlargement hollow (11) being defined by a determined profile, the profile being determined lengthwise by an angle "$\alpha$" and crosswise by an angle "$\beta$", wherein the angle "$\alpha$" should not exceed a maximum value of 5° and may vary, from the center line to the sides of the hollow (11), according to a linear development contained within a field limited at its upper end by that maximum value and at its lower end by zero.

19 Claims, 2 Drawing Sheets

CRYSTALLIZER, OR INNER PORTION, OF A MOLD FOR THE CONTINUOUS CURVED CASTING OF THIN SLABS

BACKGROUND OF THE INVENTION

This invention concerns a crystallizer, or inner portion, of a mold for the continuous curved casting of thin slabs. To be more exact, this invention concerns a crystallizer which contains in its upper portion at a position in the center of the inner side of its longer sidewalls an enlargement hollow for introduction of the discharge nozzle of tundishes.

This enlargement hollow is necessary for introduction of the discharge nozzle since the width of the space for passage of the molten metal varies from 25 to 70 mm.; this enlargement hollow is disclosed in U.S. Pat. No. 2,564,723, which teaches the symmetrical enlargement of a straight, vertical crystallizer and is therefore not suitable for curved crystallizers.

SU-A-143.215 teaches that this enlargement should be shaped with a substantially cylindrical development, and this document too concerns a straight, vertical crystallizer.

EP-A-0.230.886 is associated with a straight, vertical crystallizer and discloses a symmetrical enlargement with inclined, vertical walls having a substantially rectangular development.

DE-A-3.501.422, EP-A-0.149.734 and DE-A-3.907.351 too disclose a straight, vertical crystallizer with a symmetrical enlargement.

EP-A-0.300.953 discloses a crystallizer of which the upper portion in which the discharge nozzle of the tundish is inserted is straight and vertical, whereas the lower portion is curved; the upper portion of the crystallizer may also include an arcuate part, which can be on one long side or the other, but the document does not give any geometric defining parameter; it does not in any way disclose the case of a wholly curved crystallizer but does provide for a change of direction of the skin of the thin slab being formed. This change of direction takes place where the straight, vertical portion is joined to the lower curved portion, and creates problems for the skin being formed owing to separations, interruptions in the surface, localized melting and reduced extraction speeds.

In the technology of the state of the art, the steel during continuous casting with partly curved molds of a known type undergoes dynamic effects due to the extraction movement and to the effects of shrinkage caused by cooling.

EP-A-0.276.418 and JP-A-58-97466 disclose lateral closure elements to determine the length of the casting chamber; the former document concerns straight, vertical crystallizers, while the latter concerns curved crystallizers.

Next, it should be borne in mind that it has been deemed hitherto that an enlargement having a lenticular shape without special limitations of a geometric type would be enough for the purpose.

Since in actual practice in enlargements having a lenticular shape, that is to say, in enlargements shaped with a curve having a radius of a given value there remains a concentration of tensions, caused by the geometric configuration, in the skin forming in contact with the zone uniting the lenticular shape to the surrounding surfaces, DE-A-3.907.351 teaches the inclusion of connecting curves, which, however, are not quantified dimensionally and are therefore contained in the state of the art, which teaches that a union should be created and that a sharp edge should not be left.

Moreover, according to the teachings of the state of the art relating, in particular, to partly curved molds there remains a tendency for the removal and/or tearing of the skin during the downward movement.

In fact, the skin tends to follow a line at a tangent to its own trajectory and the present applicants have found that if this line at a tangent forms, together with the surface of the crystallizer, an angle greater than a given value, separation may occur.

Such separation takes place when the skin is consolidated enough and the ferrostatic pressure is not high enough. In such cases a breakage of the skin by tearing may take place directly.

SUMMARY OF THE INVENTION

The present applicants have designed, tested and embodied this invention to overcome the shortcomings of the state of the art and to achieve further advantages.

The applicants have found to their surprise that the above dangers and shortcomings are obviated by varying the inclination of the above tangential line which determines the development of the curve forming the enlargement hollow.

The applicants have also found to their surprise that this variation of the inclination of the tangential line should be progressive and should remain contained within a maximum value.

The applicants have also discovered to their surprise that this variation should affect the angles of departure from the lenticular surface on both the horizontal and vertical planes.

Furthermore, it has been surprisingly ascertained that this variation between one tangential line and the previous and/or successive tangential lines should be comprised within determined values.

The applicants thereafter conducted a wide and thorough practical research over a long period to obtain an experimental confirmation that their theoretical ideas correspond to the wide range of working conditions which are covered by practical operations.

According to the invention a regular downflow is ensured in practice by attributing a suitable development, comprised within an assigned field of admissibility, to the angles uniting the lenticular enlargement to the remaining surfaces; these angles are taken into consideration both in the planes of the lengthwise section (angles "$\alpha$") and in the planes of the cross-section (angles "$\beta$").

The geometry which can be achieved with the invention is able to optimize the behavior of the steel undergoing continuous casting and subjected to the dynamic effects due to the movement of extraction and the effects of shrinkage caused by cooling.

In particular, the conformation proposed for the zone uniting the lenticular surfaces makes possible:

a) a reduction of the concentration of tensions (caused by geometric effects) in the skin formed in contact with the zone uniting the lenticular surfaces to the surrounding surfaces;

b) a lessening of the tendency to removal (or tearing) of the skin during downward movement.

Hereinafter we shall denote as angle "$\alpha$" the angle determined in a vertical plane and as angle "$\beta$" the angle determined in a horizontal plane.

For the sake of ease of description we shall always refer hereinafter to the extrados, or outer curved, plate, but the content of this invention can be transferred also to the lenticular surface in the intrados, or inner curved plate.

According to the invention the angle of union "$\alpha$" relating to the lengthwise section of the crystallizer should:

—vary in a linear manner (or with a development of which the values diverge by a maximum of $\pm 0.5°$ from the values describing a straight line) upon variation of the distance of the section being considered from the nearest end of the lenticular surface;

—be comprised within a field of admissible values which is substantially rectangular and limited at its upper end to the value:

$\alpha$max. admissible$=5°$

Furthermore according to the invention the angle of union "$\beta$" relating to the cross-section of the crystallizer should:

—diminish from a maximum value to zero in a linear manner (or with a development of which the values diverge from a linear development by $\pm 0.5°$ at the most) upon variation of the distance of the section being considered from the upper plane of the crystallizer;

—be comprised within a field of admissible values which is substantially rectangular and limited at its upper end to the value:

$\beta$max. admissible$=4.5°$

BRIEF DESCRIPTION OF THE DRAWINGS

Let us now see with the help of the attached figures, which are given as a non-restrictive example, an embodiment of the invention as follows.

DETAILED DESCRIPTION OF THE PREFERRED EMBODIMENT

Let us now see an example with the help of the attached figures.

Figure 1A:
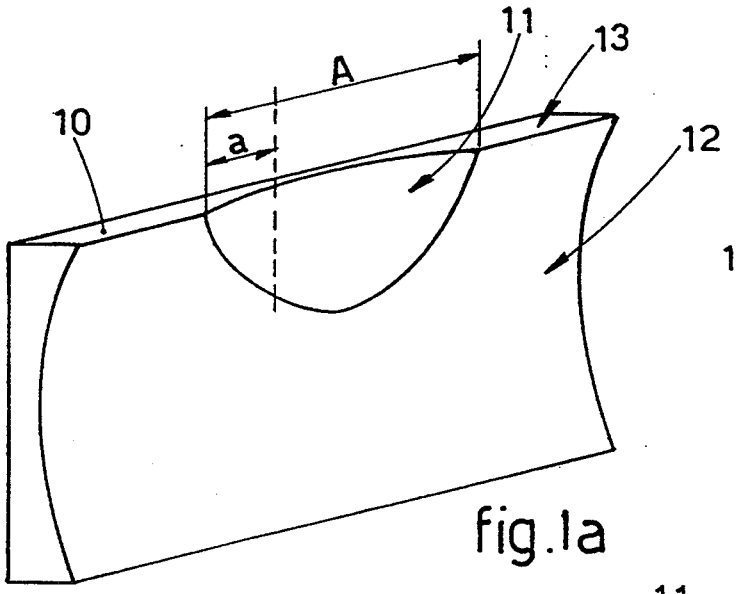
FIGS. 1*a* and 1*b* show the outer curved extrados plate together with the enlargement hollow and the angle "$\alpha$"
Figure 1B:
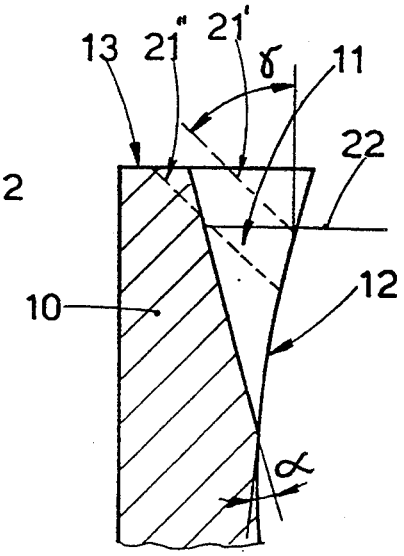
Figure 4A:
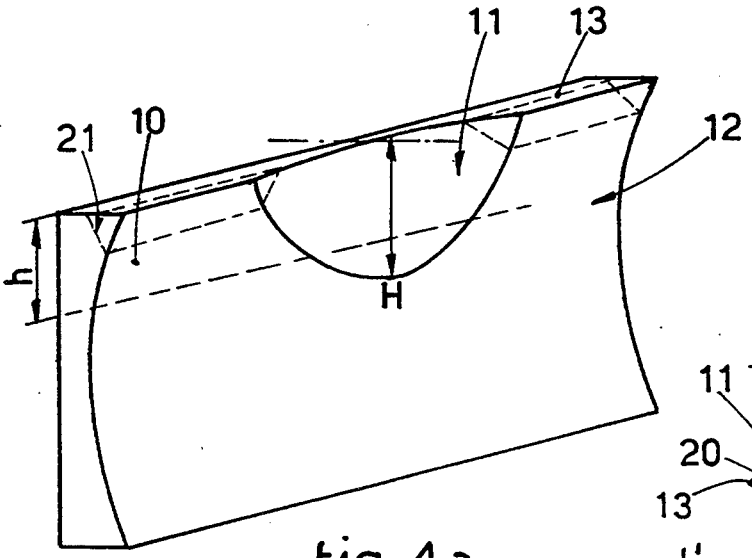
FIGS. 4*a* and 4*b* show the outer curved extrados plate and identify the enlargement hollow and the angle "$\beta$"
Figure 4B:
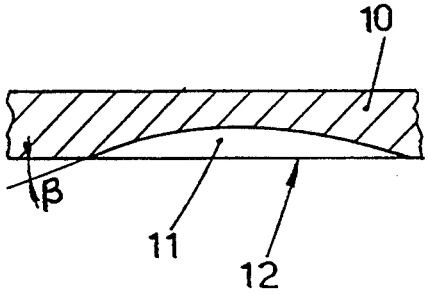

FIGS. 1*a* and 4*a* show an outer extrados plate 10 with a curved development and with an enlargement hollow 11, which starts at the upper surface 13 of the plate 10 and ends at an intermediate position where it joins the curved surface 12 defining one side of the casting channel of the crystallizer.

The hollow 11 has a height "H" and a maximum width "A" and is defined by theoretical angles "$\alpha$" and "$\beta$".

Figure 2:
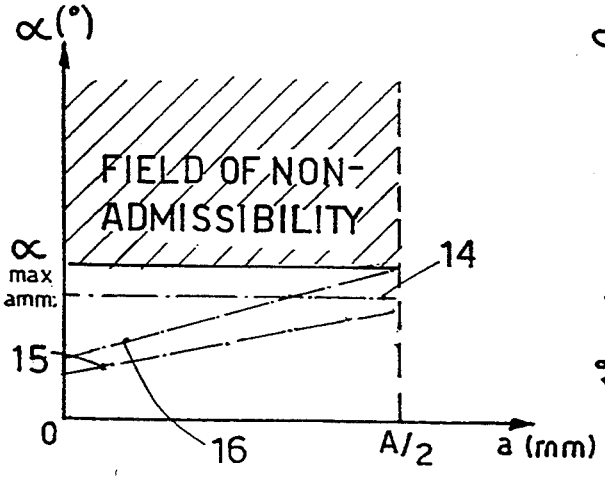
FIGS. 2 and 3 show some possible developments of the angle "$\alpha$" according to the invention.

FIG. 2 shows with lines of dots and dashes three possible developments of the angle "$\alpha$", that is to say, three possible variations within a rectangle bounded at its upper side by a field of non-admissibility; this field corresponds to values of "$\alpha$" greater than 5°.

The development 14 provides for the angle "$\alpha$" to remain constant for any lengthwise section "a", while the development 16 provides for the angle "$\alpha$" at the center line (A/2) to have a maximum value of 5°.

Figure 3:
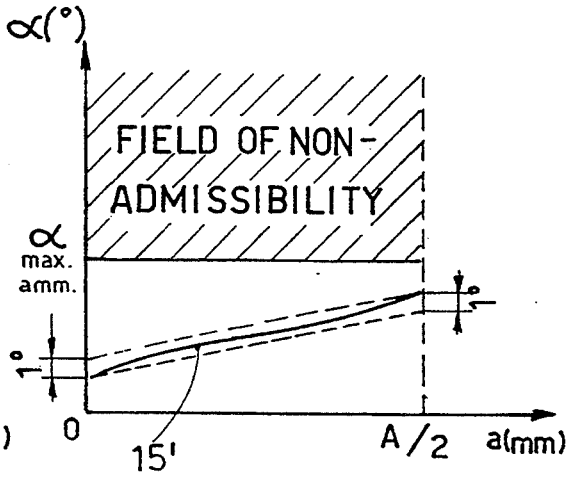

FIG. 3 shows the divergence admitted for a preselected development, which in this example is the development 15 of FIG. 2. In FIG. 3 it can be seen that the angle "$\alpha$" varies according to the development 15 while the vertical section passes from zero to A2 but can vary by $\pm 0.5°$ in relation to the development 15 so that it can take up the preferred development 15' within the band thus defined.

Figure 5:
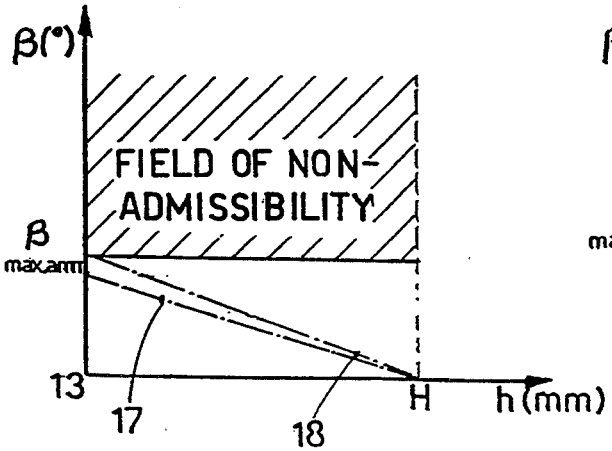
FIGS. 5 and 6 show some possible developments of the angle "$\beta$" according to the invention.

FIG. 5 shows with lines of dots and dashes two possible developments of the angle "$\beta$", that is to say, two possible variation within a rectangle bounded at its upper side by a field of non-admissibility; this field corresponds to values of "$\beta$" greater than 4.5°.

A relative angle "$\beta$" is defined by moving from the upper surface 13 towards a lower point distant by a value "h". The definition takes place by using the developments admitted by the invention; these developments are shown as an example in FIG. 5 as being two in number, namely 17 and 18 respectively.

The development 18 defines a development which starts from a maximum value of the angle "$\beta$" at the upper surface 13 and reaches the lowest point "H" with a minimum value of "$\beta$", which is zero.

Figure 6:
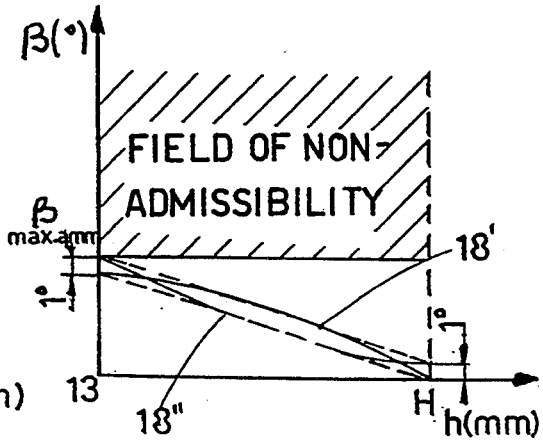

FIG. 6 shows by how much the value "$\beta$" can diverge in each section "h" from a fixed linear development, which is 18 in this case. The admitted divergence is $\pm 0.5°$ and the curves 18' and 18'' represent two permitted developments.

Figure 7:
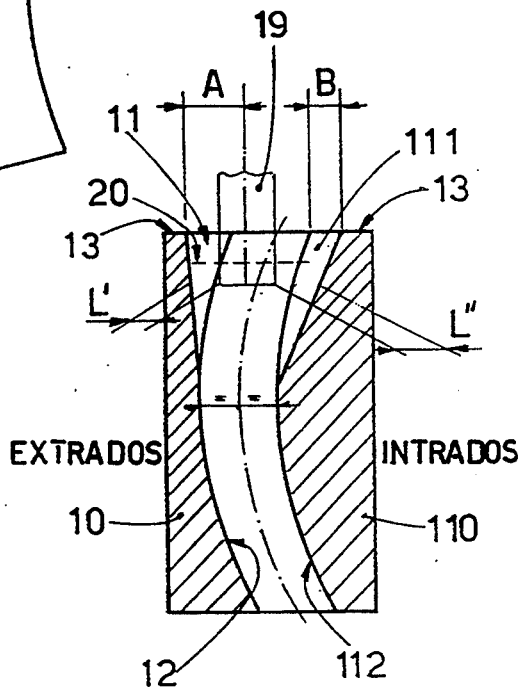
FIG. 7 is a diagram of a vertical section of a curved mold with enlargements in the outer curved extrados plate and inner curved intrados plate.

FIG. 7 shows the outer extrados plate 10 and the inner intrados plate 110, the former 10 containing the hollow 11 while the latter 110 contains the hollow 111. A discharge nozzle 19 of a tundish and the minimum level 20 of the molten metal can also be seen.

Both the hollows 11–111 are joined to the respective curves 12 and 112. The hollow 111 in the inner plate 110 is smaller than the hollow 11 in the outer plate 10 in this case although it has a depth which is substantially almost the same.

The applicants have ascertained that the discharge nozzle 19 has to be positioned in such a way that the distances L' and L'' between the discharge nozzle 19 and the walls of the hollows are substantially equal.

The applicants have also ascertained that the distances "A" and "B" relating respectively (A) to the distance between he axis of the discharge nozzle 19 and the walls of the hollow 11 in the outer extrados plate 10, and (B) to the depth of the hollow 111 in the inner intrados plate 110 are connected to each other such that the ratio B/A is approximately equal to a value in the range of from 0.6 to 1.0.

This conformation arises from the fact that the applicants have found it advantageous that the axis of the discharge nozzle 19 should cooperate with the free space in a well defined position determined by the above parameters.

The applicants have also found to their surprise that, if a bevel 21 is made at least in the upper edge of the outer extrados plate 10, the working of the casting system (mold, discharge nozzle, feeder of covering powders, feed of lubricants, etc.) is greatly improved with appreciable improvements both on the surfaces and in the structure of thin slabs which can be produced continuously.

This bevel 21' in its smallest size is between 0.4 to 0.6 times the distance of the highest level 22 of the molten metal from the upper surface 13 of the crystallizer.

The bevel 21'' in its greatest size may reach 2.5 times the distance of the highest level 22 of the molten metal from the upper surface 13 of the crystallizer.

The inclination "$\alpha$" of the bevel 21 will be between 25° and 45°, and the bevel 21 may be included in the inner plate 110 too so as to facilitate the system even more.

Figure 8:
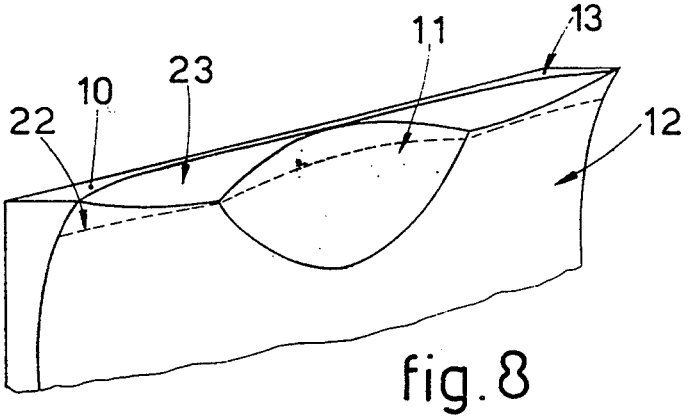
FIG. 8 shows a variant of the invention.

According to the variant of FIG. 8, a funnel-type flaring 23 may be provided instead of the bevel 21 but will be included only above the highest level 22 of the molten metal.

This flaring 23 takes the auxiliary elements such as powders and/or other elements independently towards the casting chamber defined by the hollow 11, so that those elements are then distributed at the sides in a progressive and differentiated manner.

The flaring 23 may cooperate with the upper edge (and be substantially at a tangent thereto, for instance) of the hollow 11 or may be located in an intermediate position between the upper edge of the hollow 11 and the outer edge of the outer extrados plate 10.

The flaring 23 may be included also in the inner intrados plate 110.

We claim:

1. A crystallizer of a mold for the continuous curved casting of thin slabs lengthwise through the crystallizer, comprising an outer curved extrados plate spaced from an inner curved intrados plate defining a casting channel therebetween, wherein at least the outer curved extrados plate contains a substantially central enlargement hollow starting from an upper surface of the outer curved extrados plate and being reduced progressively to zero at a lengthwise intermediate position along the curved inner surface of the outer curved extrados plate, and a funnel-type flaring cooperating with the enlargement hollow, the enlargement hollow being defined by a profile determined lengthwise by an angle "$\alpha$" and crosswise by an angle "$\beta$", wherein the angle "$\alpha$" should not exceed a maximum value of 5° and may vary, from a center line to the sides of the hollow, according to a substantially linear development contained within a field limited at its upper end by that maximum value and at its lower end by zero, and wherein the angle "$\beta$" should not exceed a maximum value of 4.5° and may vary, from the upper surface of the crystallizer to the lower end of the hollow, according to a linear development contained within a field limited at its upper end by that maximum value and at its lower end by zero.

2. A crystallizer according to claim 1, wherein the development of the angle "$\alpha$" may diverge by $\pm 0.5°$ from a perfectly linear development.

3. A crystallizer according to claim 1, wherein the development of the angle "$\beta$" may diverge by $\pm 0.5°$ from the above described linear development.

4. A crystallizer according to claim 1, wherein said inner curved intrados plate contains a substantially central enlargement hollow opposite to the hollow in the outer curved extrados plate a funnel-type flaring cooperating therewith, and wherein the hollow in the outer curved extrados plate is greater than the hollow in the inner curved intrados plate.

5. A crystallizer according to claim 4, wherein the hollows in the outer curved extrados and inner intrados plates have substantially the same depth.

6. A crystallizer according to claim 4, wherein an axis of a discharge nozzle of a tundish runs in the vicinity of the center line of the free space at the height of the lowest point of the hollows.

7. A crystallizer according to claim 6, wherein a distance "A" of the axis of the discharge nozzle from the wall of the hollow of the outer curved extrados plate and the depth "B" of the hollow of the inner curved intrados plate are related such that the ratio B/A is approximately equal to a value in the range of from 0.6 to 1.0.

8. A crystallizer according to claim 6, wherein distances L' and L'' between the lower corners of the discharge nozzle and the walls of the respective hollows are substantially equal.

9. A crystallizer according to claim 1, wherein the funnel-type flaring ends above the highest level of the molten metal.

10. A crystallizer of a mold for the continuous curved casting of thin slabs lengthwise through the crystallizer, comprising an outer curved extrados plate spaced from an inner curved intrados plate defining a casting channel therebetween, wherein at least the outer curved extrados plate contains a substantially central enlargement hollow starting from an upper surface of the outer curved extrados plate and being reduced progressively to zero at a lengthwise intermediate position along the curved inner surface of the outer curved extrados plate, and a funnel-type flaring cooperating with the enlargement hollow, the enlargement hollow being defined by a profile determined lengthwise by an angle "$\alpha$" and crosswise by an angle "$\beta$", and in that the angle "$\alpha$" is greater than zero but does not exceed a maximum value of 5° and may vary, from a center line to the sides of the hollow, according to a substantially linear development contained within a field limited at its upper end by that maximum value and at its lower end by zero.

11. A crystallizer according to claim 10, wherein the development of the angle "$\alpha$" may diverge by $\pm 0.5°$ from a perfectly linear development.

12. A crystallizer according to claim 10, wherein the angle "$\beta$" should not exceed a maximum value of 4.5° and may vary, from the upper surface of the crystallizer to the lower end of the hollow, according to a linear development contained within a field limited at its upper end by that maximum value and at its lower end by zero.

13. A crystallizer according to claim 12, wherein the development of the angle "$\beta$" may diverge by $\pm 0.5°$ from the above described linear development.

14. A crystallizer according to claim 10, wherein said inner curved intrados plate contains a substantially central enlargement hollow opposite the hollow in the outer curved extrados plate and a funnel-type flaring cooperating with the enlargement hollow, wherein the hollow in the outer curved extrados plate is greater than the hollow in the inner curved intrados plate.

15. A crystallizer according to claim 14, wherein the hollows in the outer curved extrados and inner intrados plates have substantially the same depth.

16. A crystallizer according to claim 14, wherein an axis of a discharge nozzle of a tundish runs in the vicinity of the center line of the free space at the height of the lowest point of the hollows.

17. A crystallizer according to claim 16, wherein a distance "A" of the axis of the discharge nozzle from the wall of the hollow of the outer curved extrados plate and the depth "B" of the hollow of the inner curved intrados plate are related such that the ratio B/A is approximately equal to a value in the range of from 0.6 to 1.0.

18. A crystallizer according to claim 16, wherein distances L′ and L″ between the lower corners of the discharge nozzle and the walls of the respective hollows are substantially equal.

19. A crystallizer according to claim 10, wherein the funnel-type flaring ends above the highest level of the molten metal.

* * * * *